US010112734B1

(12) United States Patent
Schrager

(10) Patent No.: US 10,112,734 B1
(45) Date of Patent: Oct. 30, 2018

(54) COLLAPSIBLE MATERIAL COLLECTION APPARATUS

(71) Applicant: Lawrence A. Schrager, Highland Park, NJ (US)

(72) Inventor: Lawrence A. Schrager, Highland Park, NJ (US)

( * ) Notice: Subject to any disclaimer, the term of this patent is extended or adjusted under 35 U.S.C. 154(b) by 0 days.

(21) Appl. No.: 15/996,443

(22) Filed: Jun. 2, 2018

(51) Int. Cl.
*B65F 1/10* (2006.01)
*B65B 55/04* (2006.01)
*B65B 67/12* (2006.01)

(52) U.S. Cl.
CPC ..... *B65B 67/1238* (2013.01); *B65F 1/10* (2013.01); *B65F 2240/138* (2013.01)

(58) Field of Classification Search
CPC ..... B65B 67/1238; B65B 55/04
USPC ..... 248/95, 97, 99; 220/9.1, 9.2, 9.3; 193/2 R, 3, 25 A
See application file for complete search history.

(56) References Cited

U.S. PATENT DOCUMENTS 1,234,057 A * 7/1917 McIntyre ..... B65B 39/08 141/314
5,205,107 A * 4/1993 Herink ..... B65B 39/08 141/390
5,775,649 A * 7/1998 O'Leary ..... B65B 67/12 141/391
5,785,369 A * 7/1998 Ridley, Sr. ..... A01D 51/00 15/257.1
5,823,225 A * 10/1998 Erickson ..... B65D 88/1612 137/347
6,116,548 A * 9/2000 Oleson ..... B65B 67/1227 248/100
6,135,518 A * 10/2000 Holthaus ..... B65B 67/12 141/337
6,293,505 B1 * 9/2001 Fan ..... B65B 67/12 141/391
6,708,742 B2 * 3/2004 Weathers ..... B65B 67/04 141/391
7,736,057 B2 * 6/2010 VanBost ..... B65B 67/04 141/114
8,020,686 B2 * 9/2011 Babineau ..... B65F 1/10 193/2 D
8,322,663 B2 * 12/2012 Bosik ..... B65B 67/1238 248/97
8,757,563 B2 * 6/2014 Muse ..... B65B 39/007 248/97
8,840,072 B2 * 9/2014 Muse ..... B65B 67/1205 248/95

(Continued)

*Primary Examiner* — Douglas A Hess
(74) *Attorney, Agent, or Firm* — Changi Wu; Law Office of Changji Wu

(57) ABSTRACT

A collapsible material collection apparatus for a container comprises a receiving funnel; a support frame; a left connection frame; a right connection frame; a connection means connecting the left connection frame to the left support frame and the right connection frame to the right support frame; a coupling means coupling the left connection frame with the right connection frame; wherein the left funnel wall is configured to be foldable inwardly with respect to the funnel floor; wherein the right funnel wall is configured to be foldable inwardly with respect to the funnel floor; and wherein the left support frame and the right support frame are configured so that the left support frame and the right support frame are retractable inwardly or expandable outwardly relative to each other.

20 Claims, 8 Drawing Sheets

(56) References Cited

U.S. PATENT DOCUMENTS

| | | | | |
|---|---|---|---|---|
| 9,056,715 | B2 * | 6/2015 | Muse | B65F 1/06 |
| 2008/0052869 | A1 * | 3/2008 | Fanning | |
| 2010/0108826 | A1 * | 5/2010 | Fernandez et al. | |
| 2018/0086492 | A1 * | 3/2018 | Weathers et al. | |

* cited by examiner

COLLAPSIBLE MATERIAL COLLECTION APPARATUS

BACKGROUND

The present invention relates generally to the field of material collection and, more particularly, with an apparatus for simplifying the numerous steps involved with the deployment of a funnel type device for corralling material into a container. One type of container commonly used in collecting material is the paper lawn bag for the collection of leaves and other debris. To this end there have been numerous attempts to create means for effective loading of collected materials into the paper lawn bag. Tubes, sleeves, funnels, chutes and others of various forms offer partial but incomplete solutions to the many facets of the deployment process.

Like the chute in U.S. Pat. No. 5,090,756 to Pfisterer et al., it discloses a foldable chute that relies on a clamp means in a form of belt to go around a bag and tighten the bag against the body of the folded chute, and a securing means to further secure the belt around the bag with the front part of the foldable chute. Pfisterer needs many cumbersome, separate parts to secure the bag to the chute. Pfisterer does not provide any means that can adjust the perimeter of the exit section of chute for easy entry of the chute into a bag, or any means that can enlarge the exit section of the chute to resist the separation of the bag from the chute. U.S. Pat. No. 8,020,686 to Babineau et al. discloses a foldable chute that has a mouth portion in contact with the ground restricted to the width of the bag unless it is flattened in which case the opening of the bag mouth becomes progressively restricted. Babineau's chute does not provide any means to adjust tension of the chute against the walls of the container in order to secure the chute against the container. US Patent Application No 2018/0086492 A1 by Weathers et al. discloses a foldable chute that lacks any means to enlarge the inner portion of the chute within the bag until a preferred expansion and commensurate force providing grip against movement between the bag and chute is achieved and maintained.

Apparatus have failed to solve the issue and encountered various drawbacks. None of them disclose the unique properties of the present invention.

BRIEF SUMMARY

This Brief Summary is included so as to introduce, in an abbreviated form, various topics to be elaborated upon below in the Detailed Description. This Brief Summary is not intended to identify key or essential aspects of the claimed invention. This Brief Summary is similarly not intended for use as an aid in determining the scope of the claims.

In one embodiment, an apparatus is provided that solves the above-described problems. For example, a collapsible material collection apparatus for a container comprises a receiving funnel defined by a funnel floor, a left funnel wall, and a right funnel wall; a support frame defined by a support frame base, a left support frame, and a right support frame; a left connection frame; a right connection frame; a connection means connecting the left connection frame to the left support frame and the right connection frame to the right support frame; a coupling means coupling the left connection frame with the right connection frame; wherein the receiving funnel further comprises a receiving end that converges to a discharging end; wherein the receiving end is relatively wider than the discharging end; wherein the support frame is configured next to the receiving funnel; wherein the left funnel wall is configured to be foldable inwardly with respect to the funnel floor; wherein the right funnel wall is configured to be foldable inwardly with respect to the funnel floor; wherein the left support frame is configured to be foldable outwardly with respect to the left funnel wall; wherein the right support frame is configured to be foldable outwardly with respect to the right funnel wall; and wherein the left support frame and the right support frame are configured so that the left support frame and the right support frame are retractable inwardly or expandable outwardly relative to each other.

Additional features and advantages of exemplary implementations of the present invention will be set forth in the Detailed Description which follows, and in part will be obvious from the description, or may be learned by the practice of such exemplary implementations.

BRIEF DESCRIPTION OF THE DRAWINGS

The accompanying drawings, which are incorporated in and constitute a part of this disclosure, illustrate various example embodiments. The components in the figures are not necessarily to scale, emphasis instead being placed upon illustrating the principles of the invention.

DETAILED DESCRIPTION

The following detailed description refers to the accompanying drawings. While embodiments of the claimed invention may be described, modifications, adaptations, and other implementations are possible. Accordingly, the following detailed description does not limit the claimed subject matter. Instead, the proper scope of the claimed subject matter is defined by the appended claims.

Figure 1:
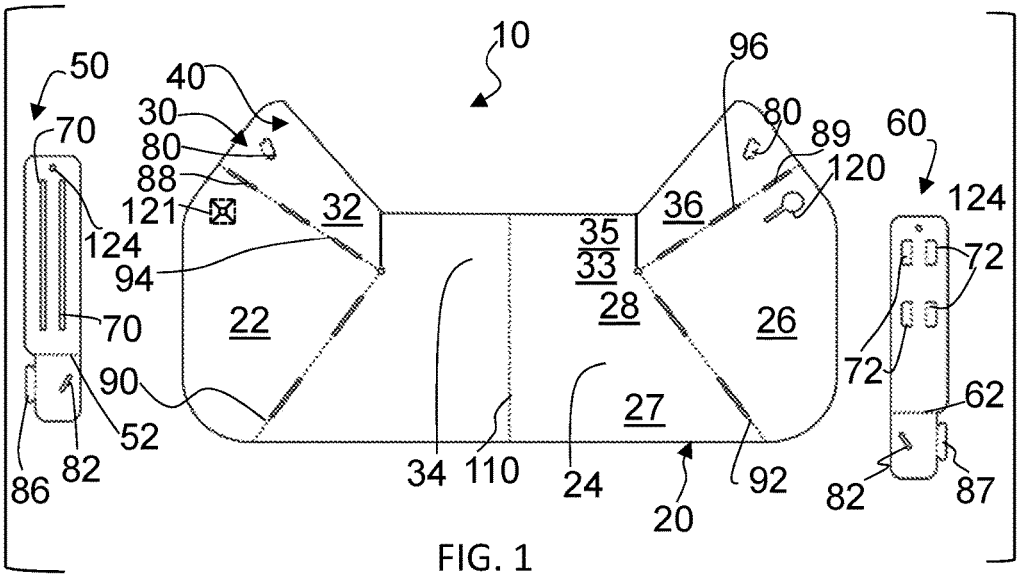
FIG. 1 is a plan view showing one of the embodiments of the invention in a flat layout.
Figure 2:
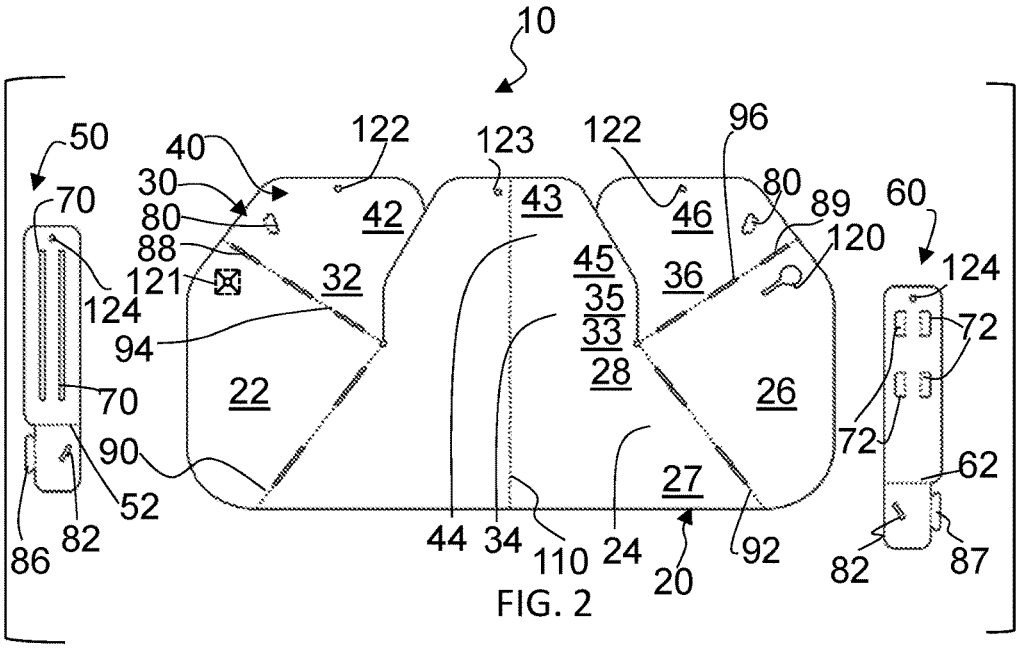
FIG. 2 is a plan view showing another embodiment of the invention in a flat layout.

Referring to FIGS. 1 and 2, one embodiment of the collapsible material collection apparatus 10 comprises a receiving funnel 20 defined by a funnel floor 24, a left funnel wall 22, and a right funnel wall 26; a support frame 30 defined by a support frame base 34, a left support frame 32, and a right support frame 36; a left connection frame 50; a right connection frame 60; a connection means connecting the left connection frame 50 to the left support frame 32 and the right connection frame 60 to the right support frame 36; a coupling means coupling the left connection frame 50 with the right connection frame 60; wherein the receiving funnel 20 further comprises a receiving end 27 that converges to a discharging end 28; wherein the receiving end 27 is relatively wider than the discharging end 28; wherein the support frame 30 is configured next to the receiving funnel 20. The support frame base 34 further comprises a first end 33 and a second end 35. The first end 33 connects to the discharging end 28 of the funnel floor 24. The width of the first end 33 is substantially equal to the width of the second end 35.

Figure 3:
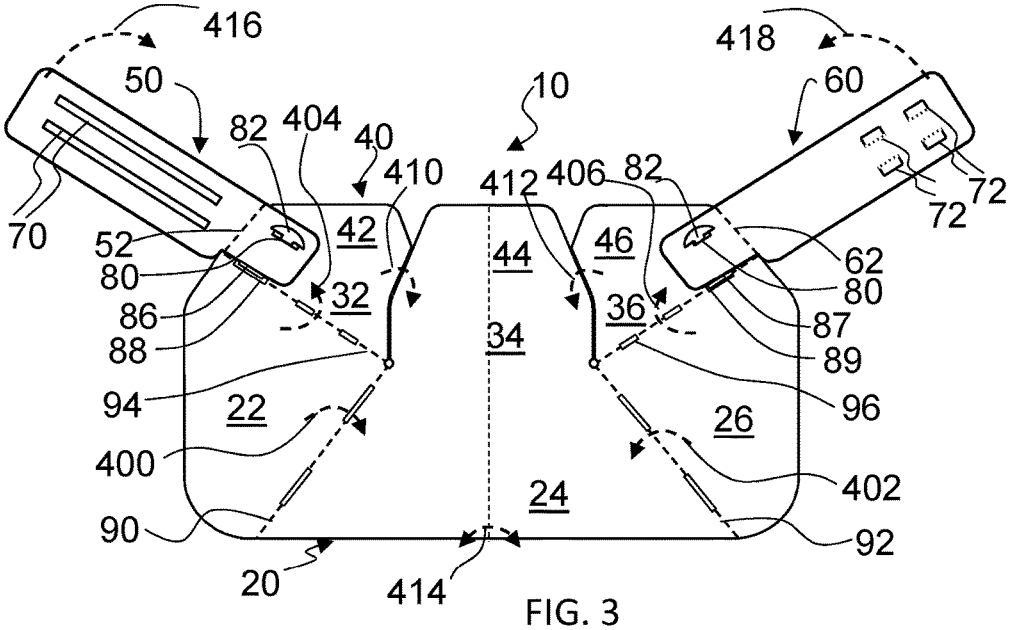
FIG. 3 is a plan view showing one of the embodiments of the invention in a flat layout that some portions of the embodiment are assembled.

Referring to FIGS. 2 and 3, in another embodiment, a guide 40, defined by a left guide arm 42, guide foot 44, and right guide arm 46, is optionally added. In one preferred embodiment, the left guide arm 42 and the right guide arm 46 are separated from the guide foot 44 and are movable to flip inwardly (as directions 410 and 412), which will facilitate the entry of the support frame into the container, especially a bag. And as shown in FIG. 2, in this embodiment, the second end 35 of the support frame base 34 is connected to the proximal end 45 of the guide foot 44.

Figure 6:
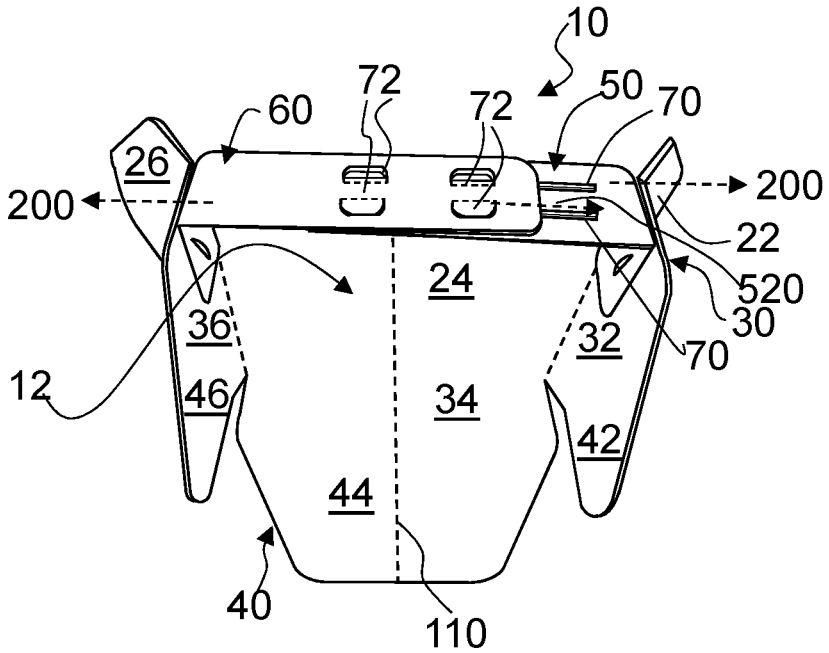
FIG. 6 is a perspective view from the side of guide showing an assembled embodiment of the invention.
Figure 7:
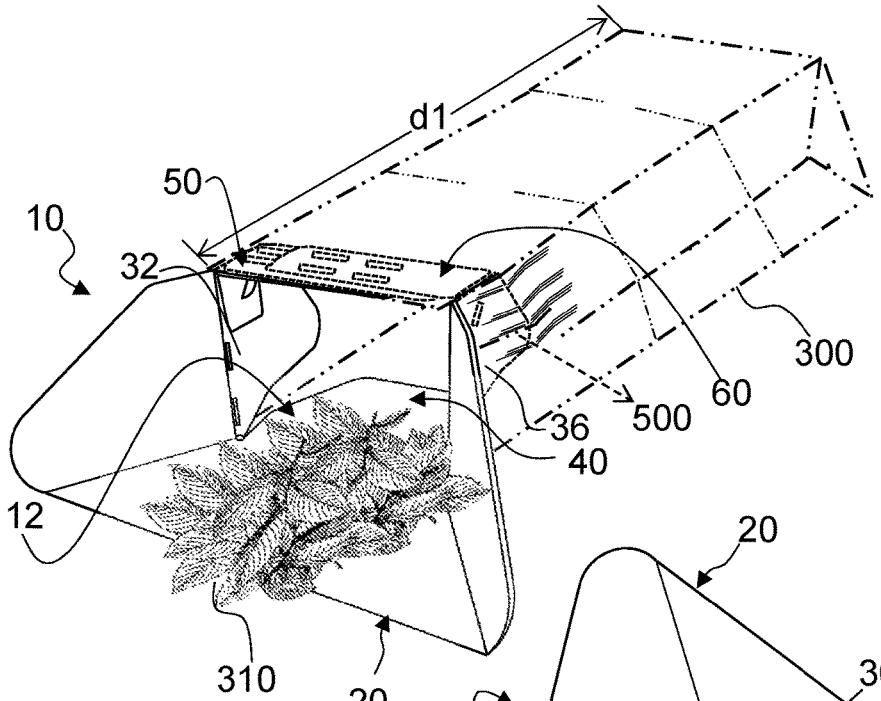
FIG. 7 is a perspective view showing one embodiment of the invention in use with a bag in a horizontal position.

Also referring to FIGS. 2, 6 and 7, in one embodiment, the guide foot 44 further comprises a distal end 43 and a proximal end 45, wherein the proximal end 45 is connected to the support frame base 34, wherein the distal end 43 is opposed to the proximal end 45, and wherein the distal end 43 is relatively narrower than the proximal end 45. Furthermore, optionally, the guide foot 44 extends relatively beyond the left guide arm 42 and the right guide arm 46 when the collapsible material collection apparatus is assembled (FIG. 6). This configuration of distal end 43, proximal end 45, and guide 40 will facilitate the entry of the guide 40 and the support frame 30 into a container. The guide foot 44 is configured to the container's dimensions that the size of the guide foot 44 may not collapse the container, for example a paper bag, when the container is empty and standing. The guide foot 44 is preferably configured that the distal end 43 of the guide 40 can facilitate the downward swing of the guide 40 when the container is tilted up to allow the collected material, such as leaves 310, to slide into the container when the guide 40 is inside the container, such as a bag 300. The depth of the guide foot 44 measured from the distal end 43 to the proximal end 45 is depending on the size of the container. A range of the depth of the support frame 30 for a typical paper lawn bag is from approximately 2 inches to 6 inches, but preferably 4 inches, approximately.

Referring to FIGS. 1, 2, 3, and 5, in one preferred embodiment of the of the collapsible material collection apparatus 10, wherein the left funnel wall 22 is configured to be foldable inwardly with respect to the funnel floor 24 as the folding direction 400 indicates; wherein the right funnel wall 26 is configured to be foldable inwardly with respect to the funnel floor 24 as the folding direction 402 indicates; wherein the left support frame 32 is configured to be foldable outwardly with respect to the left funnel wall 22 as the folding direction 404 shows; wherein the right support frame 36 is configured to be foldable outwardly with respect to the right funnel wall 26 as the folding direction 406 shows. Also referring to FIGS. 1, 2, and 3, in one preferred embodiment, score 90, score 92, score 94, and score 96 are used to make the left funnel wall, right funnel wall, left support frame, right support frame, respectively, foldable. It is understood by a person of ordinary skill in the art that scores, creases, perforations, and other methods to press a fold line on a material are equivalent to make the material foldable over the dented line. Other than scores, hinges or ring binder and other methods that have an axial and pivotal joints shall be also appreciated and practiced by a person of ordinary skill in the art to make a material foldable.

Figure 4:
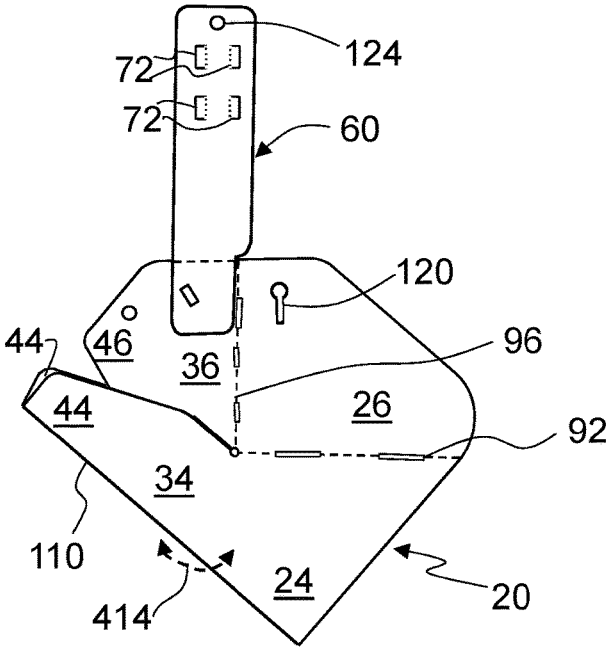
FIG. 4 is a plan view showing one embodiment of the invention folded in half.
Figure 5:
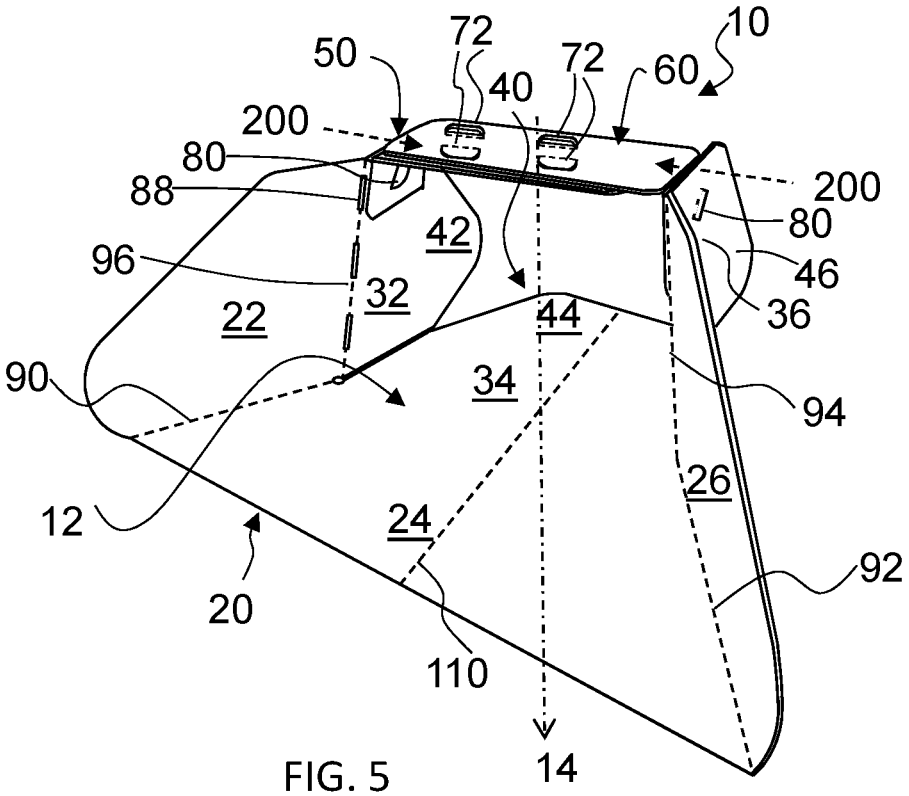
FIG. 5 is a perspective view from the side of receiving funnel showing an assembled embodiment of the invention.

Also referring to FIGS. 3, 4 and 5, in one embodiment, the left connection frame 50 moves in the moving direction 416 and the right connection frame 60 moves in the moving direction 418 when the collapsible material collection apparatus 10 is to be assembled as to the assembled embodiment shown in FIG. 5.

Now referring to FIGS. 1, 2, and 3, the connection means connecting the left connection frame 50 to the left support frame 32 and the right connection frame 60 to the right support frame 36 may comprise tabs 80 and slots 82, for example, that tabs 80 can be inserted into slots 82, or other methods, such as without limitation hook and loop fasteners, adhesives, hinges, bolts and nuts, pins, screws, clips, soldering, welding, magnets, elastic band, rivet, and other connection methods that a person of ordinary skill in the art can appreciate and practice.

Also referring to FIGS. 1, 2, and 3, in one embodiment, the securing means comprises a left slot 88 formed between the left support frame 32 and the left funnel wall 22, and the securing means comprises a right slot 89 formed between the right support frame 36 and the right funnel wall 26; wherein the securing means also comprises a left tab 86 formed on the left connection frame 50; wherein the securing means comprises a right tab 87 formed on the right connection frame 60; wherein the left tab 86 can be locked and secured by the left slot 88; and wherein the right tab 87 can be locked and secured by the right slot 89. Other securing means may comprise hook and loop fastener on the left and right support frames and the left and right connection frames. A person of ordinary skill in the art may also appreciated other securing devices, such as but not limited to pins, bolt and nuts, rivets, and adhesives.

It is understood that "inward" or "inwardly" means the moving direction toward the collection space 12 formed or to be formed in the collapsible material collection apparatus 10. In contrast, "outward" or "outwardly means that the moving direction away from the collection space 12 as shown in FIGS. 5 and 6.

FIG. 5 shows, in one embodiment, that the left connection frame 50 and the right connection frame 60 coupled by tabs 72 and slots 70 (not shown) are retracted so that the left support frame 32 is closer to the right support frame 36. In contrast to the embodiment shown in FIG. 5, FIG. 6 shows that that the left connection frame 50 and the right connection frame 60 are expanded so that the left support frame 32 is farther from the right support frame 36. When the left connection frame 50 and the right connection frame 60 are retracted toward each other, the perimeter size of the support frame will be smaller, it is easier to place the support frame 30 into the opening of a container, such as a paper lawn bag. The side walls of a paper lawn bag are flimsy, and collapse readily, especially around the mouth when it is laid on its side. It is hard to insert a frame that is similar to the size of the paper bag's opening even when the paper bag is fully opened. By retracting the support frame from the retraction between the left and right connection frames, the size of the support frame will be smaller than the size of the paper bag's opening, which make the guide and the support frame of the collapsible material collection apparatus 10 easier to be placed into the paper lawn bag. The connection frames and the support frames together can serve as a handle to lift the collapsible material collection apparatus 10.

Also referring to FIGS. 5 and 6, the left connection frame 50 and right connection frame 60 are coupled together by the tabs 72 and slots 70 so that the left support frame 32 and the right support frame 36 are adjustable to expand or retract with respect to each other in an infinite position within a working range of the slots 70, distance between the two tabs 72 on each corresponding side, and the length of connection frames 50 and 60. When tabs 72 and slots 70 are coupled together, the friction force between the tabs and slots provides a resistant force 520 to control the movement of the left connection frame 50 and the right connection frame 60 as or after the left support frame 32 and the right support frame 36 are adjusted to a desired position. Other coupling means that are adjustable but also provide a means to control or restrict the movement of the connection frames may include hook and loop fasteners, resealable adhesives, or similar coupling means as some examples shown in FIGS. 15 to 19.

Also referring to FIG. 5, in one embodiment, the left connection frame 50 and the right connection frame 60 are situated at a center of gravity 14 of the collapsible material collection apparatus 10 when the left connection frame 50 and the right connection frame 60 are coupled together and the collapsible material collection apparatus 10 is lifted from an approximate middle of the left connection frame 50 and the right connection frame 60 in a coupled status. This will provide a benefit that it is easier to hold the collapsible material collection apparatus 10 when carrying or handling by the coupled left connection frame 50 and the right connection frame 60 that is balanced at the center of gravity 14 of the collapsible material collection apparatus 10. Maintaining level balance also helps to insert the collapsible material collection apparatus 10 to into a bag 300.

Figure 8:
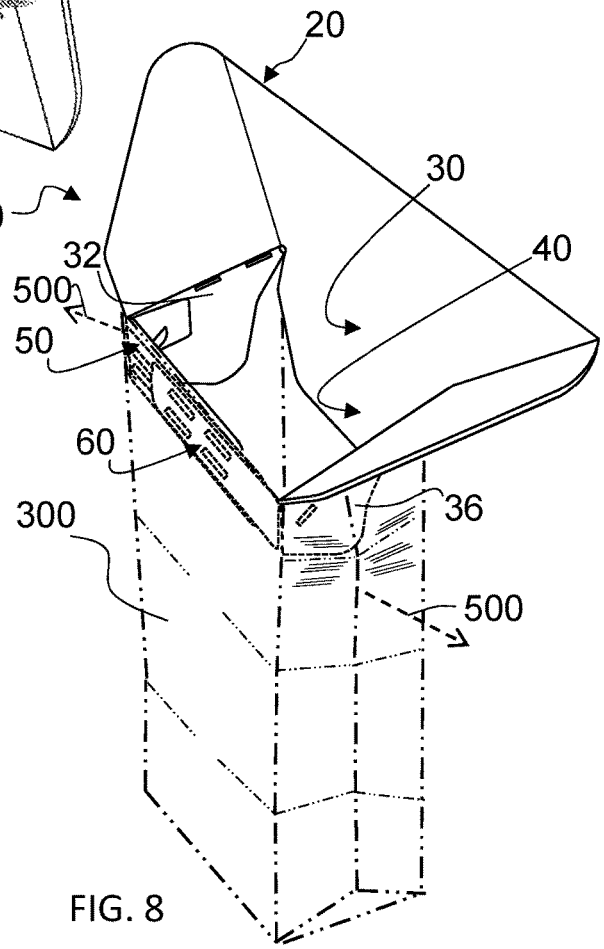
FIG. 8 is a perspective view showing one embodiment of the invention in use with a bag in a vertical position.

As shown in FIGS. 7 and 8, the expanded left support frame 32 and right support frame 36 will generate an outward force 500 outwardly against the walls of the bag 300 and that expansion will also cause an upward motion of the right and left connection frames to generate an outward force 90 degrees to the outward force 500 against bag 300. Then, the support frame 30, the right and left connection frames expand and support the bag in an open position so that materials, such as leaves 310, can pass through a maximal mouth opening into the container. Furthermore, the outward force 500 against the walls of the bag 300 increases a friction force that will allow the bag 300 to be constrained for use including lifting and repositioning with the collapsible material collection apparatus 10 without the need of clips or clamps to attach the bag with the collapsible material collection apparatus 10. Another benefit of the expanded support frame 30 is to maintain the bag in an open position and keep the bag taut and prevent collapse without using clamps or clips to hold the walls of the bag to the support frame 30. The friction force can be further increased by adding abrasive and/or traction materials on the outside surface of the support frame and or the connection means, such as but not limited to sand papers, rubbers, and adhesives, or changing the textual, pattern, or the contour of the material. As shown in FIG. 7, in one embodiment, the receiving funnel 20 is preferred to be substantially flat to the ground.

Also referring to FIGS. 7 and 8, in one embodiment, the guide 40 and the support frame 30 are substantially shorter than a depth dl of the bag 300. Therefore, the collapsible material collection apparatus does not need to extend to stand on the ground but only situates on the bag 300 if it is in a standing position.

Referring to FIGS. 1-8, the collapsible material collection apparatus 10 may be constructed of any material, such as paper, wood, metal, plastics, but lightweight materials are preferred since that lightweight material will allow the weight of the collapsible material collection apparatus to be sustained by the strength of the walls of a container, especially like paper lawn bag or similar paper-based containers as the bag 300 shown in FIG. 8. The lightweight materials, natural or manmade, may include paper, plastics, fabrics, rubber, aluminum or a combination thereof. To increase the strength of the collapsible material collection apparatus the material may be in a corrugated or reinforced form.

Figure 9:
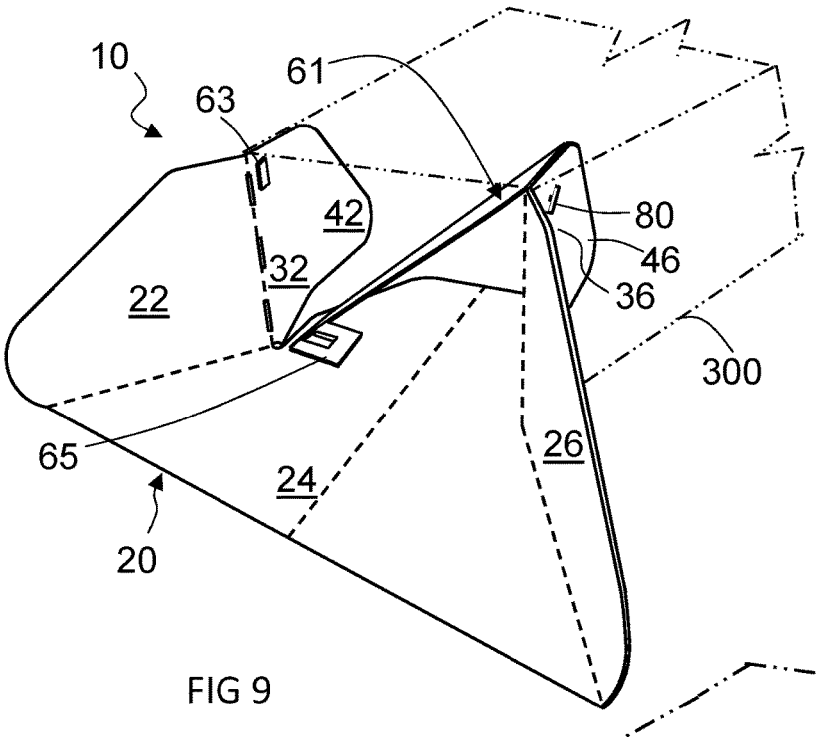
FIG. 9 is a perspective view showing one embodiment of the invention with one connection frame disconnected from the support frame.

Referring to FIGS. 3, 4 and 9, in one embodiment, wherein the collapsible material collection apparatus 10 is configured to be foldable outwardly over a central axis passing the funnel floor 24, the support frame base 34, and the guide foot 44, when the left connection frame 50 and right connection frame 60 are decoupled, as the folding direction 414 shows. In certain, typically corrugated, sheet materials that exhibit pronounced directional structural bias, it is necessary that the folding direction is one way outward as the folding direction 414. If the folding direction is inward, the funnel floor may collapse down by the counter forces imparted by the funnel wall folds. To achieve this, in one embodiment, a cut score 110 that folds in one way may be added to allow the collapsible material collection apparatus 10 to be foldable outwardly as folding direction 414 shows. In another embodiment, the cut score 110 may be substituted with one-way hinge, link, or ring binder to allow folding in any preferred direction. The folded collapsible material collection apparatus 10 will be easier to be stored and transported. Also referring to FIGS. 1 and 2, in one embodiment, a key hole 120 is formed on the right funnel wall 26 (or alternatively on left funnel wall 22) and/or a second smaller penetration of a cross slit penetration 121 is similarly formed and situated on the opposite funnel wall; first hanging holes 122 are formed on the left guide arm and right guide arm; second hanging hole 123 is formed on the guide foot; and third hanging holes 124 are formed on the right and left connection frames. Those holes are optional to allow the collapsible material collection apparatus 10 be hung on a vertical surface by the holes (FIG. 8), such holes configured to correspond with centers of gravity for each hanging position. The at least one key hole 120, and/or the cross slit penetration 121, allows a pliable container, such as plastic bag, to be secured with the collapsible material collection apparatus 10 by inserting a portion of the pliable container into the at least one key hole 120 and/or cross slit penetration 121.

Figure 10:
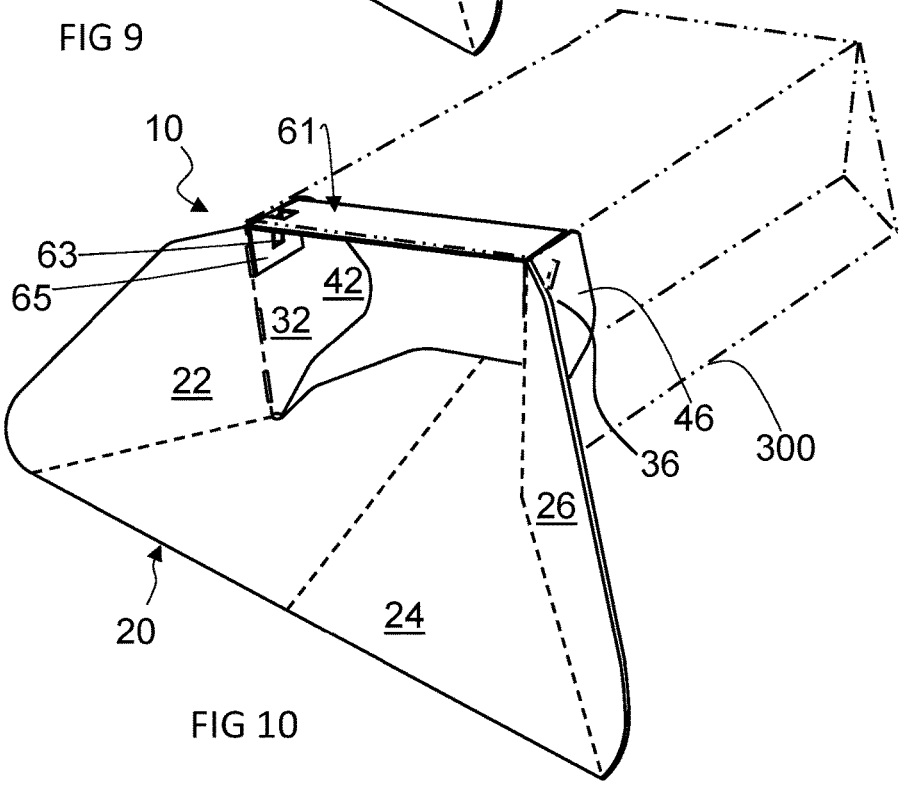
FIG. 10 is a perspective view showing one embodiment of the invention with one connection frame connected with the support frame.

Now referring to FIGS. 9 and 10, in one embodiment of the collapsible material collection apparatus 10 comprises at least one connection frame 61. The one connection frame 61 can be connected to a connection means that comprises a projection block 63 and a socket 65. The projection block 63 can be inserted into the socket 65 to connect the at least one connection frame 61 to the left support frame 32. The projection block 63 can be alternatively on the right support frame.

Figure 11:
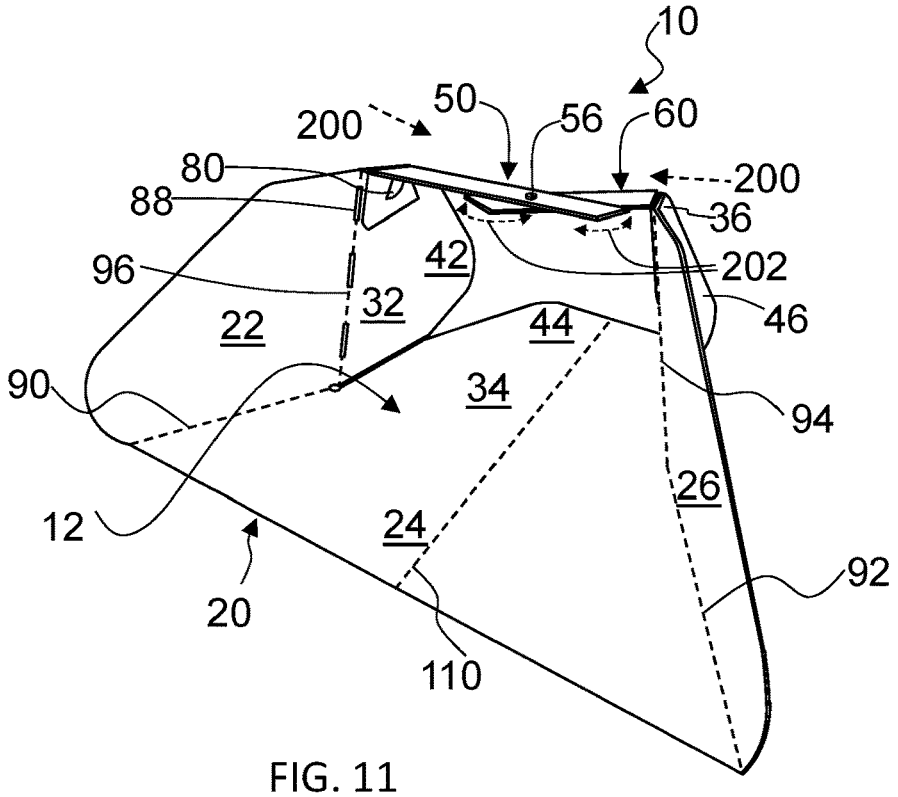
FIG. 11 is a perspective view showing one embodiment of the invention having a coupling means and connection frames that are swingable to retract the left and right support frames.
Figure 12:
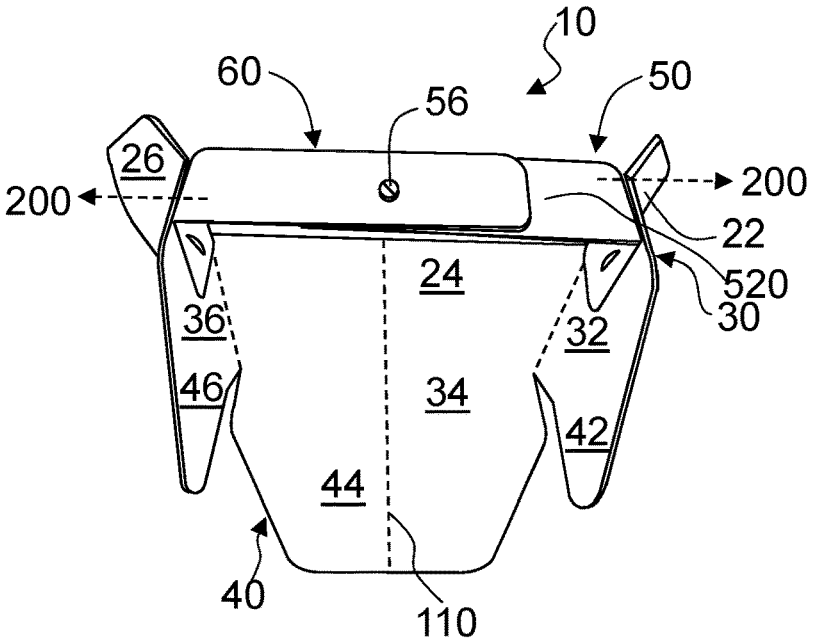
FIG. 12 is a perspective view showing one embodiment of the invention having a coupling means and connection frames that are swingable to expand the left and right support frames.

Now referring to FIGS. 11 and 12, in one embodiment of the collapsible material collection apparatus 10 comprises a coupling means that is swingable for left connection frame 50 and right connection frame 60. For example, in one embodiment shown in FIGS. 11 and 12, a rivet 56 or similar axle and rotary bearing method connects the left connection frame 50 and right connection frame 60 together but allows left connection frame 50 and right connection frame 60 to rotate or swing like a pair of scissors. When left connection frame 50 and right connection frame 60 swing around the rivet 56, the left support frame 32 and the right support frame 36 are retracted inwardly to provide a smaller perimeter size allowing the support frame 30 to enter the container, such as a paper bag easier. When left connection frame 50 and right connection frame 60 swing to align to each other, the left support frame 32 and the right support frame 36 are expanded outwardly to support the container. It is understood that the rivet 56 can be a removable rivet, a ring shape rivet (grommet), or other mechanical couplings that allows rotations around the center of the coupling. It is also noted that this coupling means can be used in the embodiment that has one connection frame.

Figure 13:
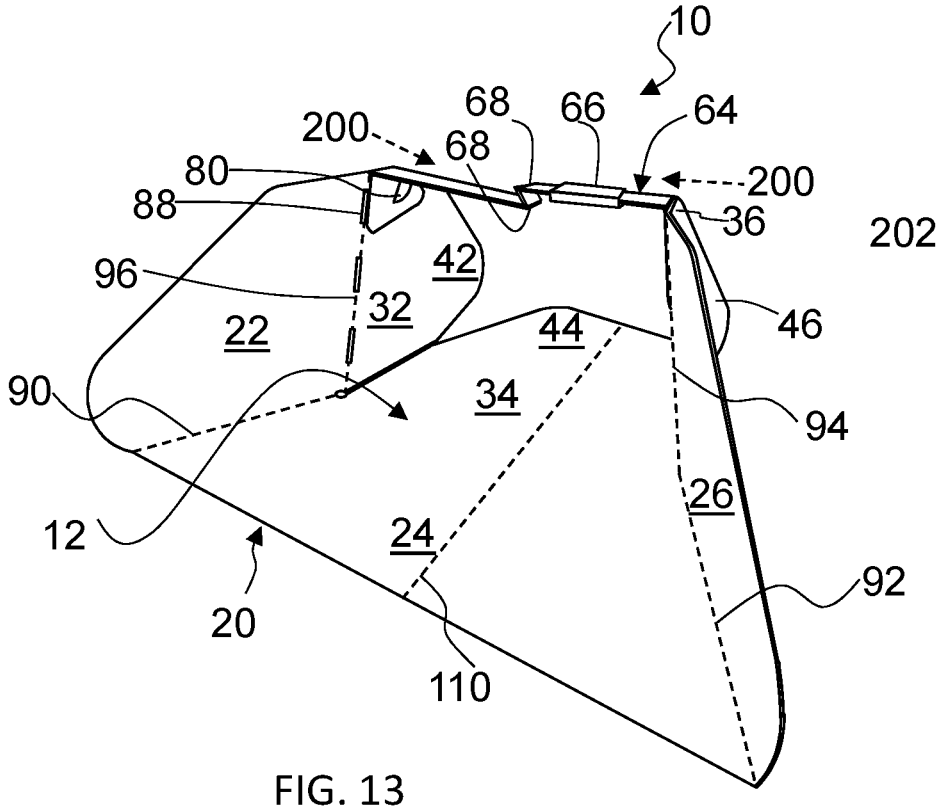
FIG. 13 is a perspective view showing one embodiment of the invention with a foldable means and a connection frame when the connection frame retracts the left and right support frames.
Figure 14:
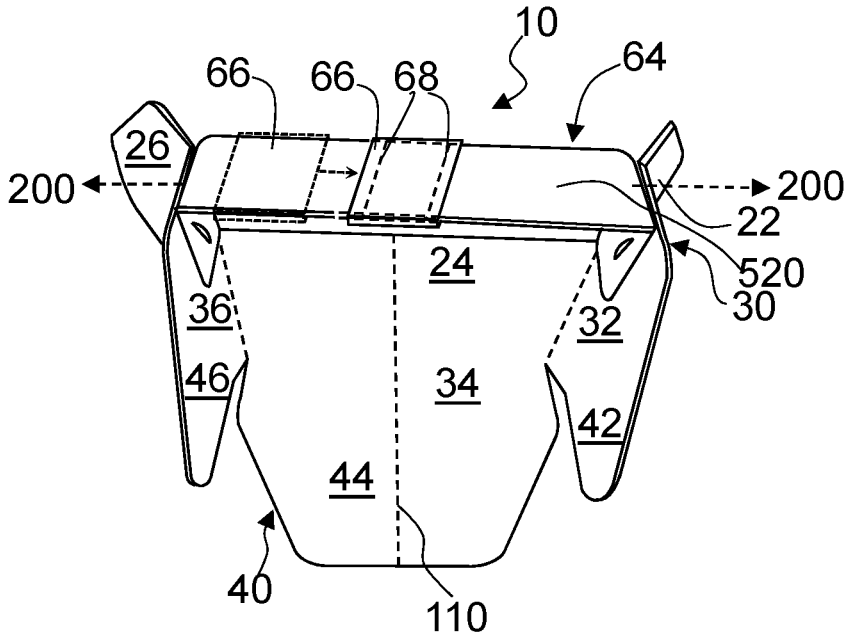
FIG. 14 is a perspective view showing one embodiment of the invention with a foldable means and a connection frame when the connection frame expands the left and right support frames.
Figure 15:
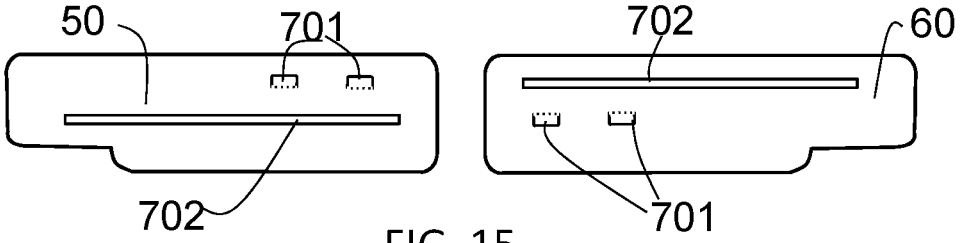
FIG. 15 is a top plane view showing one embodiment of the coupling means for the left and right connection frames.
Figure 16:
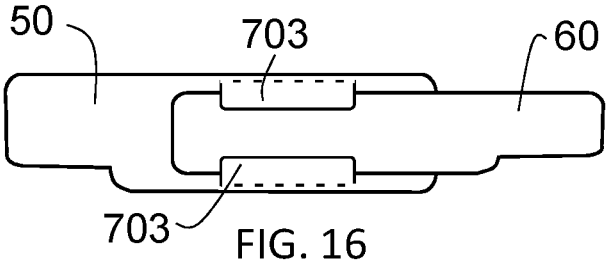
FIG. 16 is a top plane view showing one embodiment of the coupling means for the left and right connection frames.
Figure 17:
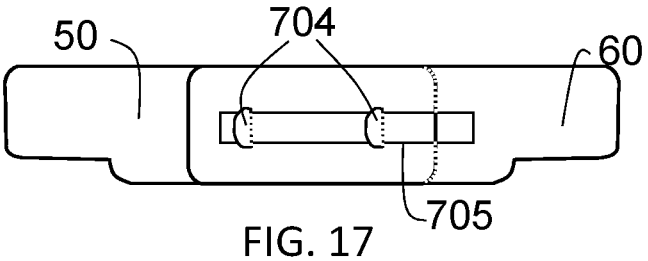
FIG. 17 is a top plane view showing one embodiment of the coupling means for the left and right connection frames.
Figure 18:
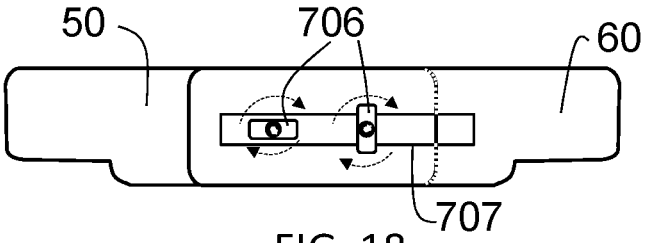
FIG. 18 is a top plane view showing one embodiment of the coupling means for the left and right connection frames.
Figure 19:
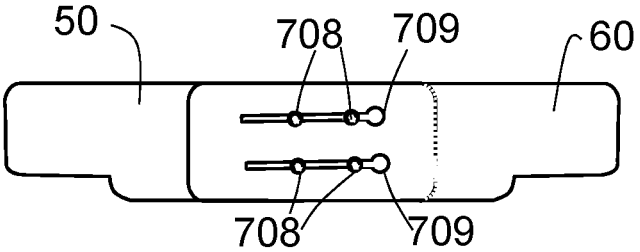
FIG. 19 is a top plane view showing one embodiment of the coupling means for the left and right connection frames.

Now referring to FIGS. 13 and 14, in one embodiment of the collapsible material collection apparatus 10 comprises at least one connection frame 64. The embodiment also comprises a slidable sleeve 66 and at least two scores 68 formed on the at least one connection frame 64. The at least two scores 68 enables the folding of the one connection frame 64 to retract the left support frame 32 and the right support frame 36 inwardly, or unfolding of the one connection frame 64 to expand the left support frame 32 and the right support frame 36 outwardly. The left support frame 32 and the right support frame 36 are retracted inwardly by folding the one connection frame 64 to provide a smaller perimeter size allowing the support frame 30 to enter the container, such as a paper bag easier. The left support frame 32 and the right support frame 36 are expanded outwardly by unfolding the one connection frame 64 to support the container. The slidable sleeve 66 can be moved over the at least two scores 68 to prevent the one connection frame to be unintentionally folded by the forces applied on the left support frame 32 and the right support frame 36. Same or similar slidable sleeve 66 can be applied to the embodiment shown on FIGS. 11 and 12 by sliding the slidable sleeve 66 over the rivet 56 and covers a portion of the connection frames to prevent the connection frames to swing around the rivet 56.

Now referring to FIGS. 3, 5, 15, 16, 17, 18, and 19 in one preferred embodiment, the left connection frame 50 and the right connection frame 60 are folded toward each other and are to be coupled by a coupling means, such as tabs 72 and slots 70, or other coupling means, such as another type of tabs 701 and slots 702 (shown in FIG. 15), shoulder tab 703 (FIG. 16), 90 degree tabs 704 and slot 705 (FIG. 17), projection bar with turn lock 706 and a slot 707 (FIG. 18), and rivet 708 with slots 709 (FIG. 19), or other methods that a person having ordinary skill in the art will appreciate and practice. In one preferred embodiment, the left support frame 32 and the right support frame 36 are configured so that the left support frame 32 and the right support frame 36 are retractable inwardly or expandable outwardly relative to each other as the moving direction 200 shows.

It is understood that the disclosed embodiments of the invention and its constituent parts described herein is an exemplary indication of a preferred embodiment of the invention, and is given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof.

I claim:

1. A collapsible material collection apparatus for a container, comprising a receiving funnel defined by a funnel floor, a left funnel wall, and a right funnel wall;

a support frame defined by a support frame base, a left support frame, and a right support frame;

a left connection frame;

a right connection frame;

a connection means connecting the left connection frame to the left support frame and the right connection frame to the right support frame;

a coupling means coupling the left connection frame with the right connection frame;

wherein the receiving funnel further comprises a receiving end that converges to a discharging end;

wherein the receiving end is relatively wider than the discharging end;

wherein the support frame is configured next to the receiving funnel;

wherein the left funnel wall is configured to be foldable inwardly with respect to the funnel floor;

wherein the right funnel wall is configured to be foldable inwardly with respect to the funnel floor;

wherein the left support frame is configured to be foldable outwardly with respect to the left funnel wall;

wherein the right support frame is configured to be foldable outwardly with respect to the right funnel wall; and wherein the left support frame and the right support frame are configured so that the left support frame and the right support frame are retractable inwardly or expandable outwardly relative to each other.

2. The collapsible material collection apparatus of claim 1, further comprising a guide defined by a guide foot, a left guide arm, and a right guide arm;

wherein the guide is connected with the support frame.

3. The collapsible material collection apparatus of claim 2, wherein the collapsible material collection apparatus is configured to be foldable over a central axis passing the funnel floor, the support frame base, and the guide foot, when the left connection frame and the right connection frame is decoupled.

4. The collapsible material collection apparatus of claim 2, wherein the guide and support frame are substantially shorter than a depth of the container.

5. The collapsible material collection apparatus of claim 2, wherein the guide foot further comprises a distal end and a proximal end, wherein the proximal end is connected to the distal end of the support frame base; wherein the distal end of the guide foot is opposed to the proximal end of the guide foot; and wherein the distal end is relatively narrower than the proximal end.

6. The collapsible material collection apparatus of claim 2, wherein the guide foot extends relatively beyond the left guide arm and the right guide arm when the collapsible material collection apparatus is assembled.

7. The collapsible material collection apparatus of claim 2, wherein the left connection frame and the right connection frame are situated at a center of gravity of the collapsible material collection apparatus when the left connection frame and the right connection frame are coupled together and the collapsible material collection apparatus is lifted from an approximate middle of the left connection frame and the right connection frame in a coupled status.

8. The collapsible material collection apparatus of claim 1, wherein the support frame is substantially shorter than a depth of the container.

9. The collapsible material collection apparatus of claim 1, further comprising a securing means to secure the left connection frame to the left support frame and the right connection frame to the right support frame.

10. The collapsible material collection apparatus of claim 1, wherein the left connection frame and right connection frame are configured with the coupling means so that the left support frame and the right support frame are adjustable to expand or retract with respect to each other in an infinite position within a working range of the coupling means; and wherein the coupling means is configured to control movement of the left support frame and the right support frame as or after the left support frame and the right support frame is adjusted to a desired position.

11. The collapsible material collection apparatus of claim 1, wherein at least one key hole and/or at least one cross slit penetration is formed on the right funnel wall or alternatively on the left funnel wall or on both the right funnel wall and the left funnel wall; and wherein the at least one key hole and/or the at least one cross slit penetration is configured to allow a portion of a pliable container to be inserted into the at least one key hole and/or at least one cross slit penetration.

12. The collapsible material collection apparatus of claim 1, wherein the support frame base further comprises a first end and a second end, and wherein a width of the first end is substantially equal to a width of the second end.

13. A collapsible material collection apparatus for a container, comprising a receiving funnel defined by a funnel floor, a left funnel wall, and a right funnel wall;

a support frame defined by a support frame base, a left support frame, and a right support frame;

at least one connection frame;

a connection means connecting the one connection frame to the left support frame and to the right support frame;

wherein the receiving funnel further comprises a receiving end that converges to a discharging end;

wherein the receiving end is relatively wider than the discharging end;

wherein the support frame is configured next to the receiving funnel;

wherein the left funnel wall is configured to be foldable inwardly with respect to the funnel floor;

wherein the right funnel wall is configured to be foldable inwardly with respect to the funnel floor;

wherein the left support frame is configured to be foldable outwardly with respect to the left funnel wall;

wherein the right support frame is configured to be foldable outwardly with respect to the right funnel wall; and wherein the left support frame and the right support frame are configured so that the left support frame and the right support frame are retractable inwardly or expandable outwardly relative to each other.

14. The collapsible material collection apparatus of claim 13, further comprising a guide defined by a guide foot, a left guide arm, and a right guide arm;

wherein the guide is connected with the support frame.

15. The collapsible material collection apparatus of claim 14, wherein the collapsible material collection apparatus is configured to be foldable over a central axis passing the funnel floor, the support frame base, and the guide foot, when the at least one connection frame is disconnected from the left support frame or alternatively from the right support frame.

16. The collapsible material collection apparatus of claim 14, wherein the guide and support frame are substantially shorter than a depth of the container.

17. The collapsible material collection apparatus of claim 14, wherein the guide foot further comprises a distal end and a proximal end, wherein the proximal end is connected to the distal end of the support frame base; wherein the distal end of the guide foot is opposed to the proximal end of the guide foot; and wherein the distal end is relatively narrower than the proximal end.

18. The collapsible material collection apparatus of claim 13, further comprising a securing means to secure the at least one connection frame to the left support frame and to the right support frame.

19. The collapsible material collection apparatus of claim 13, wherein the at least one connection frame is foldable so that the left support frame and the right support frame are adjustable to expand or retract with respect to each other.

20. The collapsible material collection apparatus of claim 13, wherein at least one key hole is formed on the right funnel wall or alternatively on the left funnel wall; and wherein the at least one key hole is configured to allow a portion of a pliable container to be inserted into the at least one key hole.

* * * * *